United States Patent [19]

Harlan et al.

[11] Patent Number: 4,979,609

[45] **Date of Patent: * Dec. 25, 1990**

[54] HOLDER FOR ENCASED COLLECTIBLE ITEMS

[75] Inventors: Sven Harlan; Ernest A. Verina, both of Norwalk, Conn.

[73] Assignee: 21st Century Coin Products, Inc., Norwalk, Conn.

[ * ] Notice: The portion of the term of this patent subsequent to Feb. 27, 2007 has been disclaimed.

[21] Appl. No.: 464,144

[22] Filed: Jan. 12, 1990

Related U.S. Application Data

[63] Continuation-in-part of Ser. No. 361,639, Jun. 5, 1989, Pat. No. 4,903,825.

[51] Int. Cl.[5] ..... A45C 11/28

[52] U.S. Cl. ..... 206/0.8; 206/44 R

[58] Field of Search ..... 206/0.8, 44 R, 0.82, 206/0.83

[56] References Cited

U.S. PATENT DOCUMENTS

| | | | |
|---|---|---|---|
| 2,752,724 | 7/1956 | Carpenter | 206/77.1 |
| 3,957,157 | 5/1976 | Therrien | 206/0.8 |
| 3,964,829 | 6/1976 | Munis | 206/0.8 |
| 4,762,512 | 8/1988 | DiVinick | 206/0.8 |

*Primary Examiner*—Joseph Man-Fu Moy

*Attorney, Agent, or Firm*—Norman B. Rainer

[57] ABSTRACT

A holding device is provided for removably securing a multitude of flat plastic cases in an orderly, easily viewable array. The device employs a substantially rigid panel having a number of series of uniformly spaced apertures, and suction cups held by said apertures. The apertures are disposed such that two suction cups are positioned to engage each plastic case.

8 Claims, 2 Drawing Sheets

HOLDER FOR ENCASED COLLECTIBLE ITEMS

RELATED APPLICATIONS

This application is a continuation-in-part of U.S. patent application Ser. No. 361,639, filed 06/05/89, now U.S. Pat. No. 4,903,825.

BACKGROUND OF THE INVENTION

This invention relates to the storage of a multitude of flat collectible items in an orderly, secure and easily reviewable array.

Flat collectible items such as stamps, coins, sports cards and the like which are generally stored in multi-paged albums are valuable possessions which the collector wishes to store in a protective yet easily viewable and re-arrangeable manner. The sports cards contain a picture of a personality well known in sports such as baseball, football, basketball or hockey. In recent years a new industry, grading services, has been created in order to stabilize rare coins and sports cards as an investment. For a fee, a grading service will examine a coin or sports card, grade it, and seal it in a tamper-proof case or "slab" which contains a serial number for the coin or card as well as its grade. Such encased or "slabbed" collectible items are a much more liquid asset than "loose", unauthenticated and ungraded items.

The cases or slabs are fabricated of a transparent plastic such as polyacrylate, and may have various sizes or shapes. A problem for buyers of such slabbed collectibles is to find practical storage means which affords some measure of security while permitting easy review or display of the collection. Large sized briefcases are currently available to coin dealers for the protective storage and transportation of large numbers of coins. However, such briefcases are impractical for the average investor having relatively few coins, and where transportation is not an issue. Boxes having a number of specially configured retaining means are also in use by coin collectors, and these require that all the coin-confining plastic cases are of the same sIze and shape.

Whereas cases for coins are generally of square configuration, cases for sports cards are of elongated rectangular configuration. A holding device for flat collectible items has been disclosed in parent application Ser. No. 361,639, said device being exemplified primarily for use with encased coins which are held by suction cups in panels which may serve as "pages" of a binder album. It has been found desirable to reduce the thickness of the panels so that more panels can be held by an album. When suction cups of thinner front-to rear size are utilized in an effort to reduce the thickness of a panel, it has been found that a single suction cup lacks sufficient holding power to retain the elongated cases.

It is accordingly an object of the present invention to provide a device and system for storing encased flat collectable items in an orderly array.

It is another object of this invention to provide a device and system as in the foregoing object which permits easy addition, removal, and review of the encased items.

It is a further object of the present invention to provide a device and system of the aforesaid nature capable of protectively storing within a relatively compact space a variable number of variously shaped plastic cases that confine flat collectable items.

It is a still further object of this invention to provide a device and system of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a holding device for flat plastic cases comprising:

(a) a substantially rigid thin panel of rectangular configuration having a number of series of uniformly spaced apertures in straight line arrays paralleling a side of said panel, and (b) a suction cup held by each aperture, said suction cups being identical, fabricated as a monolithic structure from a resilient plastic, and comprised of a stem and a conical portion, said stem being inserted into and protruding through said apertures, all conical portions of the cups of a series being disposed to face outwardly from the same surface of said panel, causing the protruding portions of said stems to be disposed upon the opposite surface of said panel, (c) said apertures being disPosed such that two suction cups from contiguous series are caused to be in sufficiently close proximity as to engage a single plastic case.

Another aspect of the present invention contemplates an assembly comprised of the aforesaid device having cases releasibly held by said suction cups, a number of such assemblies arranged in stacked relationship to form a storage system wherein the protruding portions of the stems of one assembly abut against the cases held by the next adjacent assembly in another embodiment, the conical portions are alternatively disposed upon opposite sides of the panel, thereby enabling cases to be held by both surfaces of the panel. The two suction cups associated with each case are disposed either on a vertical axis in the long direction of the case, or upon a substantially diagonal axis.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
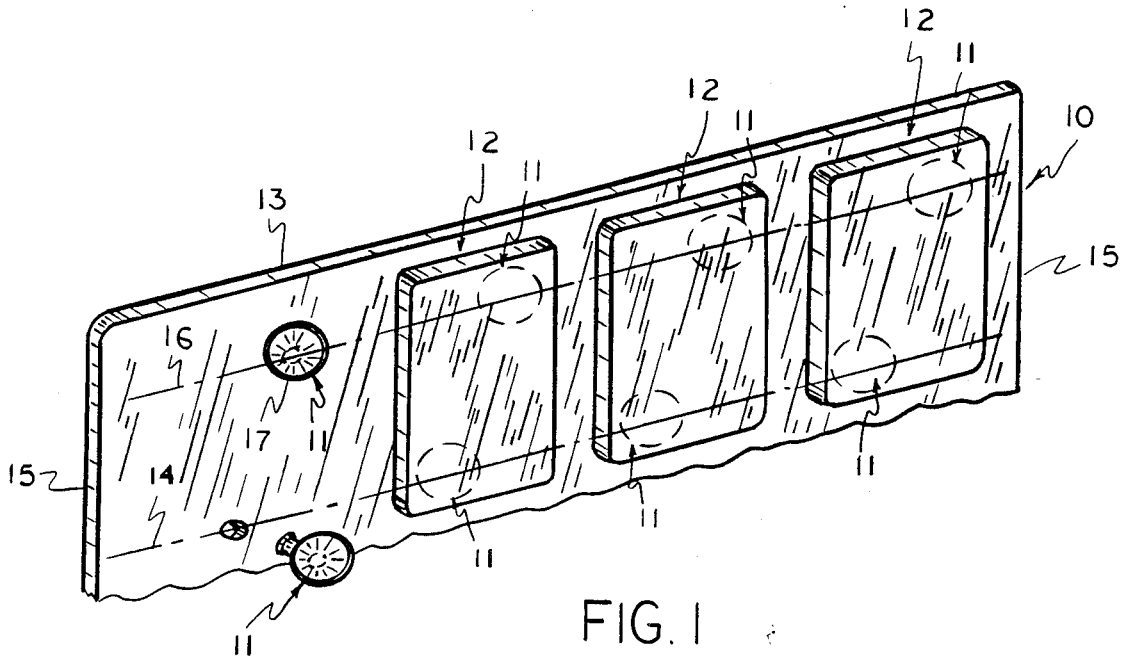
FIG. 1 is a perspective front view of an embodiment of the storage device of the present invention shown in functional association with plastic cases containing sports cards.
Figure 2:
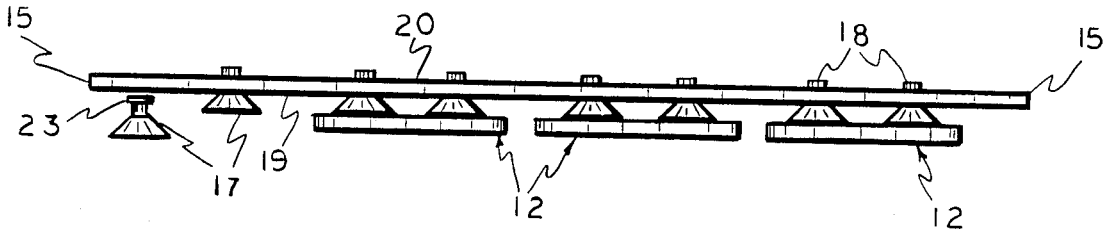
FIG. 2 is a top view of the device of FIG. 1.
Figure 3:
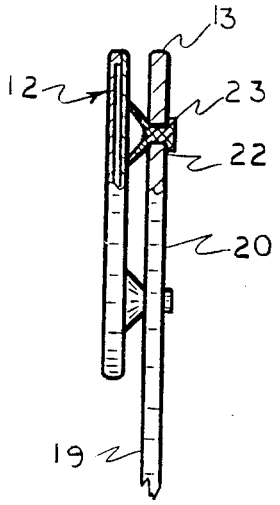
FIG. 3 is an end view of the device of FIG. 1.

Referring to FIGS. 1 through 4, an embodiment of the device of this invention and an assembly derived therefrom is shown comprised of panel 10 holding suction cups 11 which in turn secure rectangular box-like cases 12 oriented such that their long axis is vertically disposed.

Panel 10 is of substantially rigid construction, having a thickness between about 1.0 and 4.0 millimeters The term "substantially rigid" is intended to define a structure which will not bend significantly under its own weight in a direction perpendicular to the plane of the panel, and is further capable of carrying a reasonable load without deforming within the plane of the panel Suitable panels may be fabricated from plastics such as polyethylene, polyacrylates, polycarbonates, polyamides, polyesters and equivalent sheet-forming thermoplastic polymers. Transparent panels are preferable, although translucent and opaque panels may be utilized, and may contain fibrous reinforcement. The outer perimeter of the panel is rectangular. The dimensions are chosen so that about 4 to 8 cases may be held in a single row, and 1 to 7 rows may be accommodated. The illustrated panel is bounded by upper edge 13, and a parallel lower edge, not shown, end edges 15, and front and rear surfaces, 19 and 20, respectively At least one first series of apertures, positioned upon line 16, is disposed in a row parallel to edge 13 and extending between end edges 15. At least one second series of apertures, positioned upon line 14, is disposed in a row parallel to said first series. In the illustrated embodiment, each aperture of said second series is laterally displaced from the corresponding aperture of said first series, the amount of said displacement being such that suction cups positioned in said apertures will grip a case at two diagonally opposed sites. The apertures of the several rows are disposed in a linear array in the cross-direction, namely between said upper and lower edges In alternative embodiments, the two suction cups that engage a single case may be upon a vertical axis.

The suction cups are monolithic structures fabricated from resilient plastics such as plasticized polyvinylchloride having a Shore Durmeter hardness between about 60 and 80. Alternatively the suction cups may be fabricated of soft plastics such as silicones. The suction cups are comprised of a stem 22 of generally circular cylindrical configuration, and a conical portion 17 emergent from the front extremity of the stem. The stem is inserted through said apertures in a manner such that the rear extremity 18 of the stem protrudes beyond the rear surface of the panel, and the conical portions are consequently disposed upon the front surface of the panel.

The stems are accordingly of sufficient length to extend through the panel and protrude beyond the rear surface thereof The stem is held by the panel primarily by frictional force engendered by the resilient restorative force of the stem reacting from the slight deformation occasioned by its insertion through the aperture. However, a flange 23 may be present on the stem which deforms sufficiently to penetrate the panel, and then deploys in abutment with the rear surface of the panel. When a case is pressed against the conical portion of the suction cup, the case becomes secured for an indefinite duration, forming an assembly comprised of the device of this invention plus the secured cases.

Figure 4:
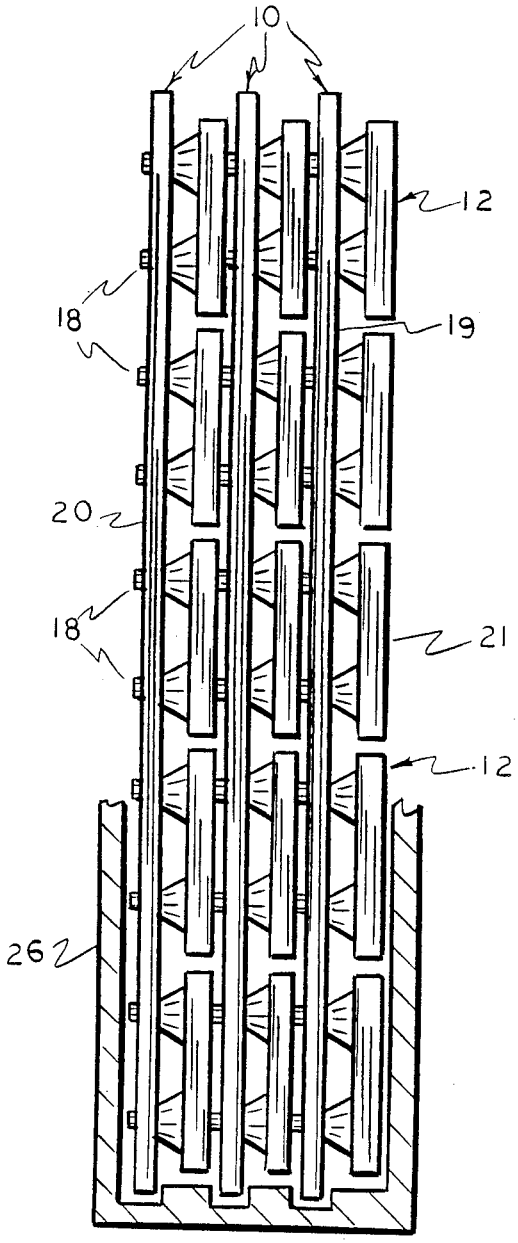
FIG. 4 is a top view of a system comprised of a number of the devices of FIG. 1.
Figure 5:
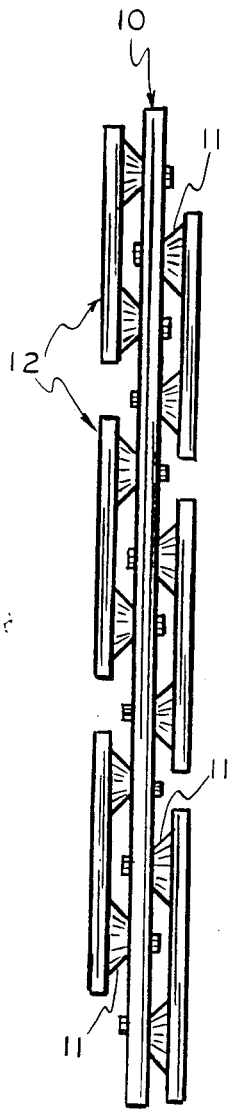
FIG. 5 is a top view of an alternative embodiment of the storage device of this invention.

In another aspect of the present invention, a number of said assemblies are arranged in a stacked relationship within confining means such as a loose-leaf binder or suitcase. In such system or stacked arrangement, as shown in FIG. 4, the protruding portions of the stems contact the front faces 21 of the cases held by the next rearwardly adjacent assembly. By virtue of such stacking, further protection is afforded the collection of cases within the system. In an alternative embodiment ilustrated in FIG. 5, cases may be disposed upon both surfaces of the panel. In such embodiment, a protective sheet is disposed between adjacent assemblies. The several assemblies are retained in removable alignment by confining means denoted by numeral 26, intended to represent a suitable or looseleaf binder.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A holding device for flat plastic cases comprising:

(a) a substantially rigid thin panel of rectangular configuration having a number of series of uniformly spaced apertures in straight line arrays paralleling a side of said panel, and (b) a suction cup held by each aperture, said suction cups being identical, fabricated as a monolithic structure from a resilient plastic, and comprised of a stem and a conical portion, said stem being inserted into and protruding through said apertures, all conical portions of the cups of a series being disposed to face outwardly from the same surface of said panel, causing the protruding portions of said stems to be disposed upon the opposite surface of said panel, (c) said apertures being disposed such that two suction cups from contiguous series are caused to be in sufficiently close proximity as to engage a single plastic case.

2. The device of claim 1 wherein said cases are of elongated rectangular configuration having a center axis of elongation and diagonal axes.

3. The device of claim 2 wherein said cases are disposed in an orientation such that said center axes of elongation are in a substantially vertical position when properly viewed.

4. The device of claim 2 wherein said two suction cups are disposed upon said axis of elongation.

5. The device of claim 2 wherein said two suction cups are substantially disposed upon a diagonal axis.

6. The device of claim 1 wherein said suction cups are disposed upon both surfaces of said panel in a manner to secure said plastic cases upon both surfaces of said panel.

7. An assembly comprised of the device of claim 1 and a multitude of flat plastic cases held thereby.

8. A storage system comprised of a number of the assemblies of claim 7 arranged in stacked relationship.

* * * * *